US008573736B2

(12) United States Patent
Ohnishi

(10) Patent No.: US 8,573,736 B2
(45) Date of Patent: Nov. 5, 2013

(54) INKJET PRINTER, INKJET HEAD, AND PRINTING METHOD

(75) Inventor: Masaru Ohnishi, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 118 days.

(21) Appl. No.: 13/203,486

(22) PCT Filed: Feb. 17, 2010

(86) PCT No.: PCT/JP2010/000970

§ 371 (c)(1),
(2), (4) Date: Aug. 26, 2011

(87) PCT Pub. No.: WO2010/098042

PCT Pub. Date: Sep. 2, 2010

(65) Prior Publication Data

US 2011/0310179 A1 Dec. 22, 2011

(30) Foreign Application Priority Data

Feb. 27, 2009 (JP) ..... 2009-045651

(51) Int. Cl.
*B41J 2/165* (2006.01)

(52) U.S. Cl.
USPC ..... 347/34; 347/102

(58) Field of Classification Search
USPC ..... 347/18, 22, 29, 34, 37, 40–44, 67, 77, 347/82, 85–86, 101–102
See application file for complete search history.

(56) References Cited

U.S. PATENT DOCUMENTS

| | | | | |
|---|---|---|---|---|
| 4,106,032 | A | 8/1978 | Miura et al. | |
| 4,301,460 | A | 11/1981 | Miura et al. | |
| 7,726,775 | B2 * | 6/2010 | Maeda | 347/37 |
| 2010/0110156 | A1 * | 5/2010 | Hara et al. | 347/102 |

FOREIGN PATENT DOCUMENTS

| | | |
|---|---|---|
| JP | S63-080131 | 5/1988 |
| JP | H08-238766 | 9/1996 |
| JP | 2000-294591 | 10/2000 |
| JP | 2002-294099 | 10/2002 |
| JP | 2003-165230 | 6/2003 |
| JP | 2007-301918 | 11/2007 |
| WO | 2006101054 | 9/2006 |

OTHER PUBLICATIONS

"1st Office Action of China Counterpart Application", with English translation thereof, issued on Jul. 19, 2013, p. 1-p. 27, in which US4106032 was cited.

* cited by examiner

*Primary Examiner* — Thinh Nguyen
(74) *Attorney, Agent, or Firm* — Jianq Chyun IP Office

(57) ABSTRACT

To suitably use a metallic ink or a pearl-colored ink in an inkjet printer. Furthermore, to suitably use an ink containing a large-sized pigment in the inkjet printer.

An inkjet printer includes an inkjet head 12 that discharges towards a printing medium 50 ink droplets of a metallic ink or a pearl-colored ink. The inkjet head 12 includes a nozzle 104 that discharges the ink droplets towards the printing medium 50, and an air blowing unit 120 that generates an airflow towards the printing medium 50 along the ink droplets discharged from the nozzle 104.

12 Claims, 5 Drawing Sheets

INKJET PRINTER, INKJET HEAD, AND PRINTING METHOD

CROSS-REFERENCE TO RELATED APPLICATION

This application is a 371 of international application of PCT application serial no. PCT/JP2010/000970, filed on Feb. 17, 2010, which claims the priority benefit of Japan application no. 2009-045651, filed on Feb. 27, 2009. The entirety of each of the above-mentioned patent applications is hereby incorporated by reference herein and made a part of this specification.

TECHNICAL FIELD

The present invention relates to an inkjet printer, an inkjet head, and a printing method.

BACKGROUND ART

Inkjet printers that perform printing by discharging ink droplets from a nozzle are widely in use. There have been endeavors in recent times to use inkjet printers for printing in metallic colored inks (metallic inks) and pearl-colored inks (pearl inks).

DISCLOSURE OF INVENTION

Problem to be Solved by the Invention

However, for reproducing prints in metallic or pearl colors properly, a shape of a pigment needs to be scale-like and a size of the pigment should be relatively large. Therefore, when a metallic ink or a pearl-colored ink is used in the inkjet printer, during discharge, the ink droplets break up into fragments at a position of a pigment, easily forming tiny satellites during discharge.

A kinetic energy of a flying droplet is proportional to its mass. The mass of the droplet in turn is proportional to a cube of its radius r ($r^3$). The radius refers, for example, to the radius when a shape of the droplet is approximated to sphere.

An air resistance that the flying droplet encounters in the air includes a component that is proportional to the radius r and a component that is proportional to a square of the radius r ($r^2$). Therefore, overall, the air resistance is proportional to a value between r and $r^2$.

Due to the relation between the kinetic energy and the air resistance, as the droplet size decreases, the impact of the air resistance becomes more prominent during the flight of the droplet through the air. Therefore, under the conditions when tiny satellites form easily, the impact of the air resistance increases, leading to formation of a mist of ink droplets. The misted ink tends to adhere to the internal parts of the printer or to the medium (printing medium), leading to staining of the internal parts of the printer or quality degradation of the medium.

Furthermore, because the satellites, which are tiny droplets, are easily influenced by the air resistance, the flight speed of the droplets drops sharply, resulting in deposition at an inaccurate position. Therefore, when a metallic ink or a pearl-colored ink is used in the inkjet printer, there is a possibility that the printed contents will have edges different from the intended result.

Moreover, when the ink droplets break up into fragments at the position of the pigment during discharge of the ink droplet, a large variation in the sizes of the ink droplets can be anticipated. Consequently, the flight speeds of the ink droplets will also vary accordingly, leading to further loss of control on the deposition position.

Due to reasons explained above, in the inkjet printer, neat reproduction has been difficult to realize using the metallic ink or the pearl-colored ink. This makes it difficult to suitably use the metallic inks or the pearl-colored inks in the inkjet printer. It is an object of the present invention to provide an inkjet printer, an inkjet head, and a printing method that can solve the problem stated above.

While searching for prior art related to the present invention, Patent Document 1 and Patent Document 2 were found. Patent Document 1 relates to a bump forming device that injects an inert gas and discharges a molten solder from a nozzle. Patent Document 2 relates to an inkjet recording device that utilizes an airflow and an electrostatic force. However, the structures described in these patent documents are for providing solutions to completely different problems than that addressed by the present invention. The structures in the patent documents are also very different from that of the present invention.

Patent Document 1: Japanese Patent Application Laid-open No. 2000-294591

Patent Document 2: Japanese Patent Application Laid-open No. H8-238766

Means for Solving Problem

The present invention has the following structure for providing a solution to the problem described above.

(Structure 1) An inkjet printer includes an inkjet head that discharges towards a printing medium an ink droplet of a metallic ink or a pearl-colored ink. The inkjet head includes a nozzle that discharges the ink droplet towards the printing medium, and an air blowing unit that generates an airflow towards the printing medium along the ink droplet discharged from the nozzle.

The nozzles are formed in the inkjet head on a nozzle surface that faces the printing medium. The air blowing unit includes a blowing port that is formed on the nozzle surface around the nozzles, and blows an airflow from the blowing port towards the printing medium. The blowing port is connected to a blower by, for example, a pipe, and blows the airflow generated by the blower.

The metallic ink or the pearl-colored ink includes, for example, pigments that have a scale-like shape. The scale-like pigment is a plate-like body having a thickness of, for example, less than or equal to 1 micrometer (μm). The pigment has a substantially square shaped principal face with each side measuring, for example, 5 μm- to 10 μm. Each side of the principal face of the pigment can be, for example, 10 μm or more. The metallic ink is of the color of a metal such as gold, silver, and aluminium. The pearl-colored ink is of the color of a pearl or any iridescent color.

With this structure, the ink droplets are caused to fly in the airflow that is directed from the nozzles towards the printing medium. As a result, a relative speed of the ink droplets with respect to the surrounding air is less than in the case when no airflow is blown. Furthermore, consequently, an impact of the air resistance on the ink droplets also reduces.

Thus, even when tiny ink droplets are formed as satellites, formation of mist can be appropriately suppressed. Furthermore, assisted by the airflow, the ink droplets tend to reach the printing medium more easily. With to this structure, the ink droplets can be made to properly reach the printing medium. Thus, the inkjet printer can print appropriately even if, for example, an ink that tends to easily form satellites, such as the metallic ink or the pearl-colored ink, is used. Consequently, the metallic inks or the pearl-colored inks can be suitably used in the inkjet printer.

Furthermore, with this structure, by assisting the flight of the ink droplets with the airflow, for example, a flight distance of the ink can be increased without the ink forming a mist. Consequently, even if a distance (gap length) between the inkjet head and the printing medium is more, printing can be performed properly. Furthermore, the metallic inks or the pearl-colored inks can be suitably used even in the inkjet printers having a large gap length.

If a speed of the ink droplet at a time of deposition of the ink droplet on the printing medium is v1, and a speed (flow speed) of an airflow around the ink droplet is v2, then the speed v1 should preferably be 0.5 to 5 times the speed v2. In the air blowing unit, a structure that forms air passages should preferably be detachable from the main unit of the inkjet head, which is the part on which the nozzles are formed, to facilitate cleaning in case of staining by the ink.

Apart from the metallic inks or the pearl-colored inks, inks such as YMCK inks can also be used. The inkjet printer can perform printing using the YMCK inks in a state in which no airflow is generated. Alternatively, as with printing with the metallic ink or the pearl-colored ink, the inkjet printer can perform printing using the YMCK inks in a state in which the airflow is generated.

(Structure 2) An inkjet printer includes an inkjet head that discharges towards a printing medium an ink droplet of an ink that contains a pigment. The inkjet head includes a nozzle that discharges the ink droplet towards the printing medium, and an air blowing unit that generates an airflow towards the printing medium along the ink droplet discharged from the nozzle. A length of the pigment in a longer direction is greater than or equal to ⅙th of a diameter of the ink droplet in a cross-section along a plane that is perpendicular to a direction from the nozzle to the printing medium.

If a diameter of the nozzle is 30 μm or less (for example, 25 μm to 30 μm), a length of the pigment in a longer direction can be, for example, 5 μm or above (for example 5 μm to 20 μm). A direction from the nozzle to the printing medium is a perpendicularly downward direction.

Even when an ink other than the metallic ink or the pearl-colored ink is used, if the ink has a large ink droplet size to pigment size ratio, the problem of formation of the satellites can occur, as in the case with the metallic ink or the pearl-colored ink. Consequently, if printing is performed by the conventional method, mist formation is likely to occur, and consequently printing cannot be performed properly.

In contrast, due to this structure, even when the tiny ink droplets are formed as satellites, the formation of mist can be appropriately suppressed and the ink droplets can be made to properly reach the printing medium. Due to this, even if the ink has a large ink droplet size to pigment size ratio, the inkjet printer can perform printing properly. Furthermore, printing can be performed properly even if the gap length is large.

A cross-section of the ink droplet refers to a cross-section taken at the widest portion. The cross-section is, for example, the cross section of an ink droplet of a standard size in the inkjet printer. The ink droplet of a standard size is an ink droplet having a volume that is set at the designing stage of the inkjet printer. A diameter of a cross-sectional surface can be calculated by conducting a simulation, etc., with an assumed volume of the ink droplet.

The pigment of the ink has an anisotropic shape such as a scale-like shape or a needle-like shape. When the pigment has a scale-like shape, the pigment has a shape similar to that of the metallic ink or the pearl-colored ink. The longer direction is the length of the longest diagonal of the principal face. The diagonal of the principal face is the diagonal of a polygon to which the principal face is approximated.

A pigment is needle-shaped when the length in the longer direction is 60 times or more than the length in a shorter direction. The length of longer direction of the pigment in this case is the length in an extension direction of the needle shape. This length is, for example, of the order of 30 μm (for example, 25 μm to 35 μm). The length of the pigment can also be 30 μm or more. The length of shorter direction of the pigment is the diameter of the cross-sectional surface that is perpendicular to the longer direction. The diameter can, for example, be a circumscribed diameter of the cross-sectional surface. The diameter is of the order of 0.5 μm (for example, 0.3 μm to 1.0 μm).

Instead of having an anisotropic shape, the pigment can have large particles having an isotropic shape, such as a spherical shape or a regular polyhedral shape. This kind of pigment can be of an ink that is used for printing over a large surface area. For example, this kind of pigment can be of white ink.

(Structure 3) The inkjet head includes on a nozzle surface thereof that faces the printing medium a plurality of the nozzles arranged in a row as a nozzle row. The inkjet head includes a plurality of the nozzles arranged in a row as a nozzle row on a nozzle surface that faces the printing medium. The air blowing unit blows generates a slit-shaped airflow from at least an area on the nozzle surface extending along the nozzle row on either side thereof.

In the inkjet printers, a printing speed is improved by having a plurality of the nozzles simultaneously discharging the ink droplets. However, if the airflow along the ink droplets is generated individually for every nozzle, it could result in a substantial increase in the cost. Furthermore, increased gap will be required between the nozzles, resulting in a problem for printing in a high resolution.

In contrast, with this structure, the airflow can be appropriately generated common to a plurality of the nozzles in a nozzle row, without either a substantial increase in the cost or decrease in the printing resolution. Furthermore, due to this, the metallic inks or the pearl-colored inks or the inks that have large-sized pigments can be used more suitably in the inkjet printer.

(Structure 4) The inkjet head discharges the ink droplet from the nozzle at an initial speed that is such that a speed of the ink droplet at a time of deposition on the printing medium is faster higher than a speed of the air flow at a time the airflow reaches the printing medium.

At a time of deposition on the printing medium, if the speed of the ink droplet relative to the airflow is 0, a deposition accuracy of the ink droplet can be adversely affected if turbulence occurs in the airflow. In contrast, with this structure, the relative speed of the ink droplet directed towards the printing medium can be positively maintained even at the time of deposition, and the ink droplet can be deposited with a greater accuracy. Furthermore, the metallic ink or the pearl-colored ink or the inks that have large-sized pigments can be used more suitably in the inkjet printer. Furthermore, if the speed of the ink droplet at the time of deposition of the ink droplet on the printing medium is v1, and a speed (flow speed) of the primary airflow around the ink droplet is v2, then the speed v1 should preferably be 1.1 to 5 times the speed v2.

Furthermore, when the effect of the turbulence in the airflow is small at the time of deposition, the speed v1 can be made 1.1 times the speed v2 or less. A wider range of speed can be set as the speed v1. For example, the speed v1 can also be set to 0.5 to 5 times the speed v2. More preferably, the speed v1 should be set 0.8 to 5 times the speed v2.

(Structure 5) The nozzle is formed on the inkjet head on the nozzle surface thereof that faces the printing medium. The air blowing unit includes a primary-airflow blowing port that generates a primary airflow towards the printing medium along the ink droplet discharged from the nozzle, and that is formed adjacent to the nozzle on the nozzle surface, and a secondary-airflow blowing port that generates a secondary airflow towards the printing medium along the ink droplet at a position that is at a greater distance from the ink droplet than a distance from the ink droplet to the primary airflow, and that is formed adjacent to the nozzle on either side of the primary-airflow blowing port on the nozzle surface.

It is advantageous to generate a streamlined airflow around the ink droplet to make the deposition accuracy of the ink droplet even more precise. With this structure, by generating the airflows at two levels, namely, the primary airflow and a secondary airflow, the primary airflow that is flowing next to the ink droplet can be further streamlined. Due to this, the ink droplet can be deposited with a greater accuracy.

Furthermore, by further streamlining the primary airflow, the speed thereof can be increased further. Consequently, the impact of the air resistance on the ink droplets can be reduced further.

The secondary-airflow blowing port blows the secondary airflow at a speed that is 0.3 to 1.2 times the primary airflow. Due to this structure, the secondary airflow can appropriately aid the primary airflow. The speed of the secondary airflow should preferably be 0.8 to 1.2 times the speed of the primary airflow.

The speed of the primary airflow and the speed of the secondary airflow are respective initial speeds. The initial speed of the primary airflow is the speed of the primary airflow immediately after it is blown from the primary-airflow blowing port. Similarly, the initial speed of the secondary airflow is the speed of the secondary airflow immediately after it is blown from the secondary-airflow blowing port.

The very existence of the secondary airflow has the advantage of aiding the primary airflow. However, for the secondary airflow to aid the primary airflow more appropriately, the speed thereof should preferably be substantially equal to or slightly less than the speed of the primary airflow. Furthermore, the primary airflow and the secondary airflow slow down in the time period until they reach the printing medium. The secondary airflow that is more outward than the primary airflow slows down even more than the primary airflow. As a result, even if the initial speed of the secondary airflow is slightly slower, there is a reversal at the time the secondary airflow reaches the printing medium, and the speed of the secondary airflow becomes nearly equal to that of the primary airflow. Thus, by setting the speed of the secondary airflow as stated above, the advantage of the secondary airflow can be further improved.

The preferred relation between the speeds of the primary airflow and the secondary airflow will change according to their respective positions, and their distances from the nozzle. Therefore, the relation between the speeds of the primary airflow and the secondary airflow should be suitably adjusted, for example, from the range given above, according to the structure of the inkjet head.

The air blowing unit can include one primary-airflow blowing port and a plurality of the secondary-airflow blowing ports that are arranged at varying distances from the primary-airflow blowing port. In such a case, the speed of at least the secondary airflow that is blown from the secondary-airflow blowing port arranged closest to the primary-airflow blowing port should preferably be set as stated above. Furthermore, the speed of the secondary airflow blown from the secondary-airflow blowing port that is closer to the primary-airflow blowing port should preferably be closer to the speed of the primary airflow. The speed of the secondary airflow that is more outward should preferably be slower than the speed of the primary airflow. With this structure, the secondary airflow can aid the primary airflow more appropriately, and the primary airflow can be more appropriately streamlined.

(Structure 6) The inkjet printer further includes an ink storage unit that stores therein the ink to be discharged from the nozzle; and a pressure adjusting unit that adjusts an ambient pressure of the ink storage unit. The pressure adjusting unit adjusts the ambient pressure of the ink storage unit by relaying an airflow blowing pressure by the air blowing unit to the ink storage unit.

To appropriately demonstrate the advantages of generation of the airflow, it is sometimes necessary to increase the speed of the airflow. For example, to form a stably streamlined airflow (primary airflow), the speed thereof needs to be increased. In such a case, the pressure of the airflow near the nozzle can become a positive pressure, leading to a reverse flow of the airflow from the nozzle into the inkjet head.

In contrast, due to this structure, the pressure inside the inkjet head is appropriately adjusted according to, for example, the air blowing pressure. Therefore, due to this structure, the pressures inside of and outside of the inkjet head can be appropriately maintained at steady levels. Thus, for example, air can be prevented from going from the nozzle into the inkjet head. Furthermore, for example, the ink can also be appropriately prevented from leaking out of the inkjet head from the nozzles.

The ink storage unit is an intermediate tank that is provided in an area on an ink supplying side inside the inkjet head or in between in an ink supply channel to the inkjet head. The pressure adjusting unit is a pipe that is connected to the ink storage unit. The pipe is branched at a point between the blower that generates the airflow (primary airflow) and the blowing port of the airflow.

Due to this structure, even if the pressure of the blower varies, the variation in the pressures inside of and outside of the inkjet head, which is connected via the nozzle, is cancelled out. Thus, due to this structure, the pressures inside of and outside of the inkjet head can be maintained at steady levels.

(Structure 7) An inkjet head discharges an ink droplet of a metallic ink or a pearl-colored ink towards a printing medium. The inkjet head includes a nozzle that discharges the ink droplet towards the printing medium; and an air blowing unit that generates an airflow towards the printing medium along the ink droplet discharged from the nozzle. This Structure produces the same advantages as, for example, Structure 1.

(Structure 8) An inkjet head discharges towards a printing medium an ink droplet of an ink that contains a pigment. The inkjet head includes a nozzle that discharges the ink droplet towards the printing medium; and an air blowing unit that generates an airflow towards the printing medium along the ink droplet discharged from the nozzle. A length of the pigment in a longer direction is greater than or equal to ⅙th of a diameter of the ink droplet in a cross-section along a plane that is perpendicular to a direction from the nozzle to the printing medium. This Structure produces the same advantages as, for example, Structure 2.

(Structure 9) A printing method for printing by an inkjet method by discharging an ink droplet of a metallic ink or a pearl-colored ink towards a printing medium includes discharging the ink droplet from a nozzle towards the printing medium; and blowing from an air blowing unit an airflow towards the printing medium along the ink droplet discharged from the nozzle. When performed in this manner, the same advantages as, for example, Structure 1 can be achieved.

(Structure 10) A printing method includes printing by an inkjet method by discharging an ink droplet of an ink containing pigments towards a printing medium. A length of the pigment in a longer direction is greater than or equal to ⅙th of a diameter of the ink droplet in a cross-section along a plane that is perpendicular to a direction from a nozzle to the printing medium. The printing method includes discharging the ink droplet from the nozzle towards the printing medium; and blowing from an air blowing unit an airflow towards the printing medium along the ink droplet discharged from the nozzle. When performed in this manner, the same advantages as, for example, Structure 2 can be achieved.

Advantages of the Invention

According to the present invention, metallic inks or pearl-colored inks can be suitably used in inkjet printers. Furthermore, inks that have large-sized pigments can be suitably used in inkjet printers.

BEST MODE(S) FOR CARRYING OUT THE INVENTION

Exemplary embodiments of the present invention are explained below with reference to the accompanying drawings. FIG. 1 is an example of a structure of an inkjet printer 10 according to an embodiment of the present invention. The inkjet printer 10 is a printing apparatus that prints on a printing medium 50 by an inkjet method. The inkjet printer 10 includes an inkjet head 12, an ink bottle 14, an intermediate ink tank 16, a blower 18, an airflow supply pipe 20, and an airflow branch pipe 22.

In the present embodiment, the inkjet printer 10 is a printing device that performs printing by a multi pass method, and causes the inkjet head 12 to perform a scanning movement whereby the inkjet head 12 moves while discharging ink droplets. For this purpose, the inkjet printer 10 further includes, for example, a not shown head driving mechanism for moving the inkjet head 12, a not shown transport mechanism for transporting the printing medium 50, etc.

The inkjet head 12 is a print head that includes nozzles 104 for discharging the ink droplets. In the present embodiment, the inkjet head 12 includes a plurality of the nozzles 104 arranged in a line as a nozzle row 106 on a nozzle surface that faces the printing medium 50. An air blowing unit 120 surrounds the nozzle row 106. The air blowing unit 120 blows an airflow along the ink droplets discharged from the nozzles 104, directing the ink droplets towards the printing medium 50. In the present embodiment, because of the airflow, the inkjet head 12 lends assistance in the flight of the ink droplets. A structure for blowing the airflow, and an effect thereof will be explained in detail later.

The ink bottle 14 is a bottle that stores therein an ink for use in the inkjet printer 10. The intermediate ink tank 16 is a tank that stores therein the ink in between in an ink channel that connects the ink bottle 14 to the inkjet head 12. The intermediate ink tank 16 stores therein the ink received from the ink bottle 14, and supplies the ink to the inkjet head 12 as the printing operation progresses. In the present embodiment, the intermediate ink tank 16 functions as an ink storage unit that stores therein the ink prior to its discharge from the nozzles 104. As a modification of the present invention, a region on an ink supplying side inside the inkjet head 12 or the ink bottle 14, etc., can be used as the ink storage unit.

In the present embodiment, the inkjet printer 10 performs printing using at least a metallic ink or a pearl-colored ink. Therefore, the ink bottle 14 and the intermediate ink tank 16 store therein the metallic ink or the pearl-colored ink.

Apart from the metallic ink or the pearl-colored ink, the inkjet printer 10 can additionally use other types of ink according to the requirement. For example, the inkjet printer 10 can in addition use YMCK inks to perform printing. Alternatively, the inkjet printer 10 can use both the metallic ink and the pearl-colored ink. When the inkjet printer 10 uses plural types of the inks, the inkjet printer 10 is provided with, for example, a separate ink bottle 14 and a separate intermediate ink tank 16 for the ink of each color.

The blower 18 is an airflow generating device that generates an airflow. The airflow generated by the blower 18 is supplied to the inkjet head 12 via the airflow supply pipe 20. The airflow generated by the blower 18 is blown into the inkjet head 12 through the air blowing unit 120.

The airflow supply pipe 20 is a pipe that connects the blower 18 to the inkjet head 12, and supplies the airflow generated by the blower 18 to the inkjet head 12. The airflow branch pipe 22 is a pipe that branches off from the airflow supply pipe 20. Because the airflow branch pipe 22 is connected to the intermediate ink tank 16, the blower 18 and the intermediate ink tank 16 are interconnected.

With this structure, the airflow branch pipe 22 relays an airflow blowing pressure that is the same as that in the air blowing unit 120 provided in the inkjet head 12 to the intermediate ink tank 16 that is the ink storage unit. Thus, the airflow branch pipe 22 functions as a pressure adjusting unit that adjusts an ambient pressure of the ink storage unit.

To appropriately achieve the advantages of generation of the airflow, it is sometimes necessary to increase a speed of the airflow. In such a case, the pressure of the airflow near the nozzles 104 is set to a positive pressure, which leads to a reverse flow of the airflow from the nozzles 104 into the inkjet head 12.

In contrast, in the present embodiment, the pressure inside the inkjet head 12 is appropriately adjusted according to, for example, the airflow blowing pressure. Therefore, the pressures inside of and outside of the inkjet head 12 can be appropriately maintained at steady levels. Thus, for example, air can be prevented from going from the nozzles 104 into the inkjet head 12. Furthermore, for example, the ink can also be appropriately prevented from leaking out of the inkjet head 12 from the nozzles 104.

Furthermore, in the present embodiment, for example, even if the pressure of the blower 18 fluctuates, the fluctuations in the pressures inside of and outside of the inkjet head 12, which is connected via the nozzles 104, is cancelled out. Thus, in the present embodiment, for example, the pressures inside of and outside of the inkjet head 12 can be appropriately maintained at steady levels.

FIG. 2 and FIG. 3 are drawings of examples of the structure for blowing the airflow, and the effect thereof. In FIG. 2, the ink droplets discharged from the nozzles of the inkjet head are shown as a modelized representation of the flight of the ink droplet when no airflow is being blown. In the inkjet method, when the ink is discharged, apart from a main droplet (main drop), there are often droplets, called satellites, that are smaller than the main drop. The satellites, being small in mass with a low kinetic energy, are more easily influenced by an air resistance than the main drop.

(a) in FIG. 2, for example, shows an example of mist formation of the satellites of the ink when an ordinary inkjet ink, such as a YMCK ink, is discharged from the nozzles. In order to be deposited on the printing medium 50, the ink droplet discharged from the inkjet head must fly through a flight distance that is greater than or equal to a gap length Lg between the inkjet head and the printing medium 50. However, the satellites, which are small, are influenced by the air resistance more than the main drops. Consequently, the satellites are slowed down more quickly than the main drops, preventing them from reaching the printing medium 50. Caught in the airflow, the satellites form a mist.

(b) in FIG. 2 shows an example when the gap length Lg is longer. When the gap length Lg is longer, as shown in (b) in FIG. 2, the main drop also becomes a mist because of the greater impact of the air resistance on the ink droplet until it reaches the printing medium 50. Therefore, it is necessary to set the gap length Lg such that the main drop reaches the printing medium 50. In the inkjet printer in which the YMCK ink having a droplet size of 3 picoliter (pl) is used, the gap length Lg should, for example, be 2 millimeter (mm) to 4 mm.

(c) in FIG. 2 shows an example in which the metallic ink or the pearl-colored ink is used. In the present embodiment, the metallic ink or the pearl-colored ink includes pigments that have a scale-like shape. The scale-like pigment is a plate-like body having a thickness of, for example, less than or equal to 1 μm. The pigment has a substantially square shaped principal face with each side measuring, for example, 5 μm to 10 μm.

When discharged from the nozzles, this type of ink tends to easily break up into fragments at a position of the pigment, forming small satellites as a result. Immediately upon being discharged from the nozzles, these satellites lose their kinetic energy due to the impact of the air resistance, and tend to form a mist. When this type of ink is used, most of the ink droplets fail to reach the printing medium 50 even if the gap length Lg is of the order that is used for the YMCK ink. Furthermore, this kind of ink that is slowed down as soon as it is discharged from the nozzles is deposited at inaccurate positions, and therefore cannot be used in the conventional structure of the inkjet printer. In contrast, in the inkjet printer 10 explained with reference to FIG. 1, the flying ink droplet properly reaches the printing medium 50 assisted by the airflow.

FIG. 3 is a more detailed drawing of the example of the structure of the inkjet head 12, and shows a structure in the vicinity of the nozzles 104 in a cross section of the inkjet head 12 that lies in a plane that is parallel to a discharge direction of the ink droplets.

This cross section is perpendicular to a row direction of the nozzle row 106.

In the present embodiment, in the inkjet head 12, the nozzles 104 are formed on the nozzle surface that faces the printing medium 50. Furthermore, around the nozzles 104, the air blowing unit 120 includes a primary-airflow blowing port 108 and secondary-airflow blowing port 110.

The primary-airflow blowing port 108 is a blowing port formed adjacent to the nozzle row 106 on the nozzle surface, and blows a primary airflow directed towards the printing medium 50 along the ink droplets discharged from the nozzles 104. Thus, the primary-airflow blowing port 108 blows the airflow that directly lends assistance in the flight of the ink droplets.

The secondary-airflow blowing ports 110 are blowing ports formed adjacent to the nozzles 104 on either side of the primary-airflow blowing port 108 on the nozzle surface. The secondary-airflow blowing ports 110 blow a secondary airflow towards the printing medium along the ink droplets at a position that is at a greater distance from the ink droplets than a distance from the ink droplets to the primary airflow. The secondary airflow is an airflow that, for example, controls the flow of the primary airflow by flowing along the primary airflow. In the present embodiment, by flowing along the primary airflow, the secondary airflow guides the primary airflow even faster while maintaining a streamlined primary airflow. Thus, the secondary-airflow blowing ports 110 blow the airflow that lends assistance in the flight of the ink droplets indirectly via the primary airflow.

In the present embodiment, the secondary airflow blown from the secondary-airflow blowing port 110 is a somewhat smaller airflow than the primary airflow, but is blown at substantially the same speed as the primary airflow towards the printing medium 50. With this structure, a more streamlined primary airflow can be realized. The speed of the secondary airflow is preferably, for example, 0.3 to 1.2 times, or more preferably, 0.8 to 1.2 times the speed of the primary airflow. With this structure, the secondary airflow can aid the primary airflow more appropriately, and a more streamlined primary airflow can be realized.

Furthermore, in the present embodiment, to guide the streamlined primary airflow even faster, the air blowing unit 120 includes, for a single primary-airflow blowing port 108, a plurality of the secondary-airflow blowing ports 110 at varying distances from the primary-airflow blowing port 108. The secondary-airflow blowing port 110 that is closer to the primary-airflow blowing port 108 should preferably blow the secondary airflow at a speed that is closer to that of the primary airflow. With this structure, a more streamlined primary airflow can be realized.

Furthermore, in the present embodiment, as shown in a 3D enlarged view in FIG. 3, the airflow blown from the primary-airflow blowing port 108 is a slit-shaped airflow, with a longer direction thereof being parallel to the nozzle row 106. The airflows blown from the secondary-airflow blowing ports 110 are slit-shaped and parallel to the primary airflow. Thus, the air blowing unit 120 forms slit-shaped airflows in the same direction as the discharge direction of the ink droplets, covering the entire nozzle row 106.

In a modification of the present invention, by widening the primary airflow, the primary airflow can be appropriately streamlined without the aid of the secondary airflow. The width of the primary airflow is a width of the slit in the slit-shaped airflow. In such a case, the airflow blown from the air blowing unit 120 (primary airflow) should be of a width that is preferably greater than or equal to 10% of the gap length.

How the ink droplets are discharged in the inkjet printer is explained next. As shown in FIG. 3, at a time of discharge of an ink droplet in the inkjet printer, a column of ink (ink column) that extends from the nozzles 104 is formed according to a discharge pressure that acts in the direction from inside the inkjet head 12 to outside the inkjet head 12. The ink forms into an ink droplet at the end of the ink column. When the ink droplet detaches itself from the ink column, it is discharged towards the printing medium 50 as an ink droplet. The discharged ink droplet travels towards the printing medium 50 at an initial speed determined by the discharge pressure.

When the ink containing pigments that are scale-like, for example, the metallic ink or the pearl-colored ink, is used, the ink droplets detach from the ink column at the position of the pigment before the main drop, which is an ink droplet that should have been originally formed. As a result, as shown in FIG. 3, the satellites of various sizes are formed, which are easily influenced by the air resistance in the known inkjet printers.

In contrast, in the present embodiment, the ink droplets are caused to fly in the airflow that is directed from the nozzles 104 towards the printing medium 50. As a result, a relative speed of the ink droplets with respect to the surrounding air is less than in the case when no airflow is blown. When traveling towards the printing medium 50, the ink droplets encounter the air resistance that is determined by the relative speed in the surrounding air. As a result, given that the speed is the same in both the cases, the impact of the air resistance on the ink droplets traveling in the primary airflow is less than in the case when no airflow is blown.

Thus, according to the present embodiment, even when the tiny ink droplets are formed as satellites, the formation of mist can be appropriately suppressed. Furthermore, assisted by the airflow, the ink droplets tend to reach the printing medium 50 more easily. Consequently, according to the present embodiment, when the distance is at least that of the gap length or greater, the ink is discharged straight towards the printing medium 50, enabling the ink droplets to properly reach the printing medium 50.

Thus, the inkjet printer can print appropriately with a high accuracy even if, for example, an ink that tends to easily form satellites is used. Furthermore, for example, the metallic inks or the pearl-colored inks, etc., can be suitably used in the inkjet printer.

Furthermore, according to the present embodiment, by assisting the flight of the ink droplets with the airflow, for example, the flight distance of the ink can be increased without the ink forming a mist. Consequently, even if the gap length is more, printing can be performed properly. Furthermore, the metallic inks or the pearl-colored inks can be suitably used even in the inkjet printers having a large gap length.

Furthermore, according to the present embodiment, by generating the airflows at two levels, namely, the primary airflow and the secondary airflow, and allowing the secondary airflow to flow around the primary airflow, a more stably streamlined primary airflow is formed near the ink droplets. Consequently, the ink droplets can be deposited with a greater accuracy. Moreover, by further streamlining the primary airflow, the speed thereof can be increased further. Consequently, the impact of the air resistance on the ink droplets can be reduced further.

Furthermore, because the primary airflow can be guided farther away, primary airflow is formed properly even if the gap length is increased. Consequently, a highly accurate printing can be realized even if the gap length is increased.

Other than the metallic inks or the pearl-colored inks, the problem of formation of the satellites can occur in any ink that has a large an ink droplet size to a pigment size ratio. For example, the problem of satellite formation is likely to occur if a length of the pigment in a longer direction is greater than or equal to ⅙th of a diameter of the ink droplet in a cross-section along a plane that is perpendicular to a direction from the nozzle to the printing medium. Thus, the structure for assisting the flight of the ink droplets by the airflow described above is effective for these inks.

The structure for assisting the flight of the ink droplets by the airflow described above is applicable to a normal inkjet ink, such as YMCK inks. Because the flight distance of the ink droplets can be increased through the assistance of the airflow, the gap length between the inkjet head 12 and the printing medium 50 can be increased. For example, the gap length can be increased to 10 mm or more (for example, 10 mm to 100 mm).

The ink droplet and the speed of the airflow in the present embodiment are explained next. In the present embodiment, the inkjet head 12 discharges the ink droplet from the nozzles 104 at an initial speed of v10 such that a speed v1 of the ink droplet at a time of deposition on the printing medium 50 is greater than a speed v2 of the primary airflow surrounding the ink droplet. The initial speed v10 of the ink droplet that has entered the primary airflow is accelerated to a speed obtained by adding a speed of the primary airflow to the initial speed v10.

The speed v1, for example, is the speed of the ink droplet at a time of deposition. This ink droplet, for example, is of a preset size set according to a required deposition accuracy. The ink droplet can be the main drop, or the satellite, of a preset size. Furthermore, the speed v2 is the speed of the primary airflow at a time the airflow reaches the printing medium 50. The air blowing unit 120 generates the primary airflow at an initial speed corresponding to the speed v2. The speed v1 should preferably be 0.8 to 5 times the speed v2.

When the speed v1 is equal to the speed v2, the relative speed of the two speeds becomes zero, and there is no impact of the air resistance. The ink droplet reaches the printing medium 50 even in this case. However, the ink droplet is influenced by the primary airflow at the time of deposition, and tends to be carried by the airflow. The condition $v1-v2>0$ is an essential determining factor for an accurate deposition position.

Upon reaching the printing medium 50, the primary airflow flows along the surface of the printing medium 50 in a direction away from the ink droplet. Consequently, turbulence in the airflow can easily occur near the printing medium 50. If the speed v1 is equal to the speed v2, the deposition position of the ink droplet can become inaccurate due to the turbulence, and the deposition accuracy can be affected.

In contrast, in the present embodiment, at the time of deposition too, the kinetic energy of the ink droplet is maintained, and the tiny ink droplet can be made to fly a greater distance with a high deposition accuracy. Consequently, the metallic inks and the pearl-colored inks or the inks that have large-sized pigments can be suitably used in the inkjet printer.

In the time period until the ink droplet reaches the printing medium 50, the speed of the ink droplet varies according to a magnitude relation between the speed of the ink droplet and the speed of the primary airflow, the impact of the air resistance encountered by the ink droplet within the primary airflow, etc. If the speed of the ink droplet is greater than the speed of the primary airflow, the speed of the ink droplet slows down within the primary airflow. If the speed of the ink droplet is smaller than the speed of the primary airflow, the ink droplet accelerates within the primary airflow.

Furthermore, when the effect of the turbulence in the airflow is small at the time of deposition, the speed v1 can be made 1.1 times the speed v2 or less. A wider range of speed can be set as the speed v1. For example, the speed v1 can also be set to 0.5 to 5 times the speed v2. More preferably, the speed v1 can be set 0.8 to 5 times the speed v2.

FIG. 4 is a more detailed drawing of a first example of a structure of the inkjet head 12. (a) in FIG. 4 is a cross-sectional view of the inkjet head 12 and (b) in FIG. 4 is a drawing of the inkjet head 12 viewed from underside (nozzle surface).

In the present embodiment, the inkjet head 12 has a structure in which single-color inkjet heads, each of which discharges the ink of one color among a plurality of colors being used, are integrated as a single unit. The inkjet head 12, for example, includes a single-color inkjet head for discharging the ink of each of the colors of the YMCK inks, and a single-color inkjet head for discharging the metallic ink or the pearl-colored ink. Each single-color inkjet head includes a nozzle plate 102 with the nozzle row 106 formed thereon.

Each single-colored inkjet head includes the air blowing unit 120, a primary-airflow feed port 112, and a secondary-airflow feed port 114. The air blowing unit 120 includes the primary-airflow blowing port 108 and the secondary-airflow blowing ports 110 that are slit-shaped and that surround the nozzle row 106. Thus, the air blowing unit 120 blows slit-shaped airflows from areas extending along a direction of the nozzle row 106 on either side thereof.

The primary-airflow feed port 112 is a feed port for the air blown as the primary airflow. The secondary-airflow feed port 114 is a feed port for the air blown as the secondary airflow. In the present embodiment, the primary-airflow feed port 112 and the secondary-airflow feed port 114 are connected to the blower 18 via the airflow supply pipe 20, and receive from the blower 18 air having a pressure according to the airflow blown from the primary-airflow blowing port 108 and the secondary-airflow blowing ports 110, respectively. Alternatively, the primary-airflow feed port 112 and the secondary-airflow feed port 114 each can be provided at one place in the inkjet head 12, common to all the nozzle rows 106, as in the example explained later with reference to FIG. 5.

According to the present embodiment, the airflow is appropriately generated around the flying ink droplet. Thus, the metallic inks or the pearl-colored inks can be suitably used in the inkjet printer.

Furthermore, a high print resolution can be achieved by generating the airflows per nozzle row 106 rather than per nozzle 104. Moreover, a substantial increase in the cost for providing the air blowing units 120 can also be prevented. The body of the inkjet printer according to the conventional manufacturing technique can be used. Thus, the increase in the cost can be further suppressed.

In the air blowing unit 120, it is preferable that a structure that forms air passages be detachable from the inkjet head 12 main unit to facilitate cleaning in case of staining by ink.

As long as all the nozzle rows 106 receive uniform airflow of the same strength, the number of feed ports for the airflows, the structure of the air passage on the nozzle surface, etc., can be suitably changed. For example, by bulkheading the air passage with a barrier in a direction of the airflow, the mechanical strength of the airflow can be increased, and the airflow can be further streamlined.

For the sake of ease of explanation, a structure having only one nozzle row 106 per color has been described above. However, two or more nozzle rows 106 per color can also be provided. By having such a structure, the printing speed and the print resolution can be increased. In such a case, the air blowing unit 120 generates the slit-shaped airflows from areas on either side of a plurality of the adjacent nozzle rows 106.

FIG. 5 is a more detailed drawing of a second example of a structure of the inkjet head 12. (a) in FIG. 5 is a cross-sectional view of the inkjet head 12 and (b) in FIG. 5 is a drawing of the inkjet head 12 viewed from underside (nozzle surface). The inkjet head 12 described in the present embodiment is identical to or similar to the inkjet head 12 explained with reference to FIG. 4 in all respects except the point explained below.

In the present embodiment, the inkjet head 12 has a structure in which the nozzle rows 106 of the nozzles 104, each of which discharges the ink of one color among a plurality of colors being used, are provided as an integrated unit. In this case, the inkjet head 12 includes the nozzle plate 102 in which are formed a plurality of the nozzle rows 106, each of which corresponds to one color. Each of the nozzle rows 106 corresponds, for example, to one of the YMCK inks and the metallic ink or the pearl-colored ink.

Furthermore, in the present example, the inkjet head 12 includes the primary-airflow feed port 112 and the secondary-airflow feed port 114 for the air blowing unit 120 corresponding to the nozzle row 106 for each color. The air blowing unit 120 corresponding to the nozzle row 106 for each color generates the air fed from the primary-airflow feed port 112 and the secondary-airflow feed port 114 each provided at one place. Alternatively, the inkjet head 12 can include a separate primary-airflow feed port 112 and a separate secondary-airflow feed port 114 for each air blowing unit 120 corresponding to the nozzle row 106 for each color.

In the present embodiment too, the airflow can be appropriately produced around the flying ink droplet. Thus, the metallic inks or the pearl-colored inks can be suitably used in the inkjet printer.

Although the present invention has been described with respect to a specific embodiment for a complete and clear disclosure, the appended claims are not to be thus limited, but are to be construed as embodying all modifications and alternative constructions that may occur to one skilled in the art which fairly fall within the basic teaching herein set forth.

INDUSTRIAL APPLICABILITY

The present invention can be suitably used in inkjet printers.

Figure 1:
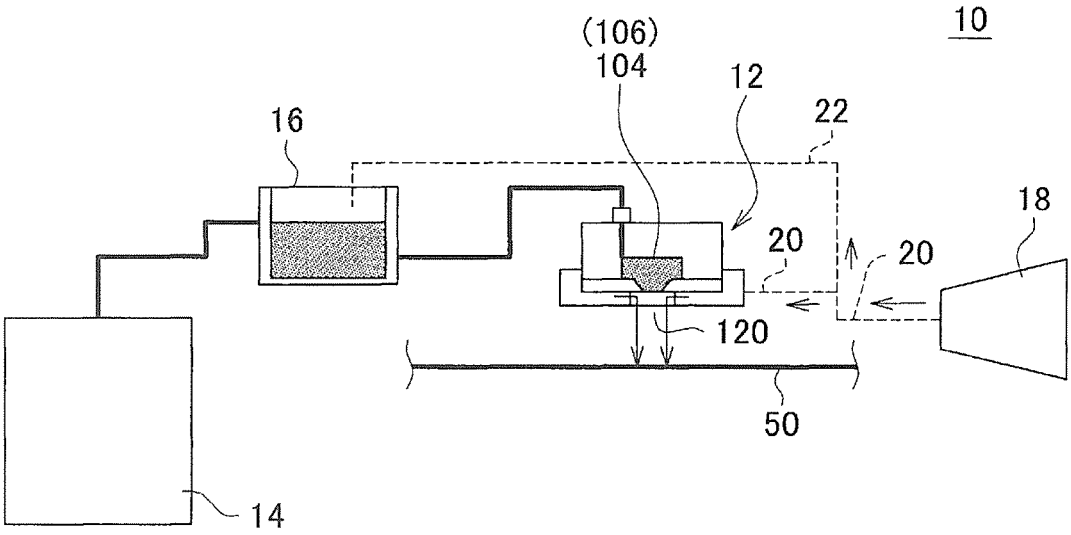
FIG. 1 is an example of a structure of an inkjet printer 10 according to an embodiment of the present invention.
Figure 2:
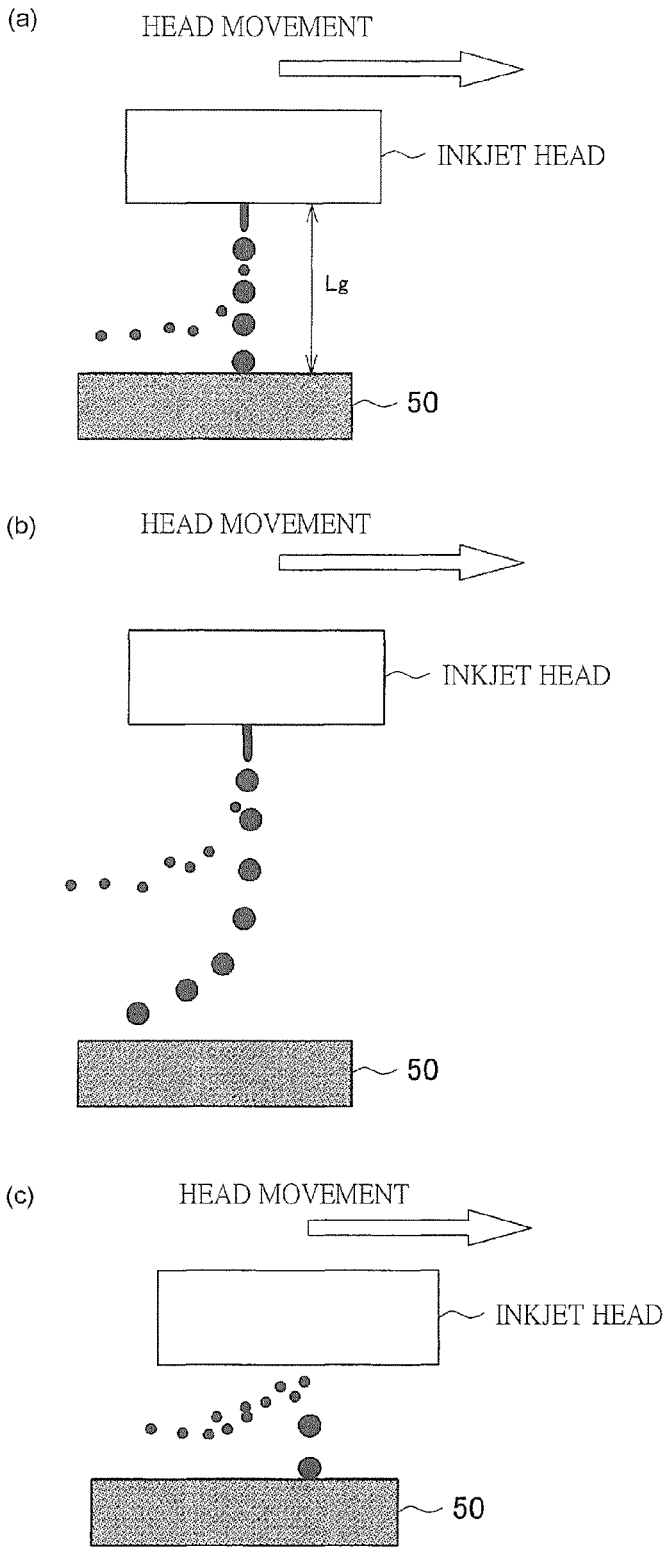
FIG. 2 is a modelized representation of ink droplets discharged from a nozzle of an inkjet head where (a) in FIG. 2 is an example of mist formation by satellites of an ink in a case of a normal inkjet ink, such as YMCK inks, being discharged from the nozzle, (b) in FIG. 2 is an example of a case where a gap length Lg is increased, and (c) in FIG. 2 is an example of a case where a metallic ink or a pearl-colored ink is used.
Figure 3:
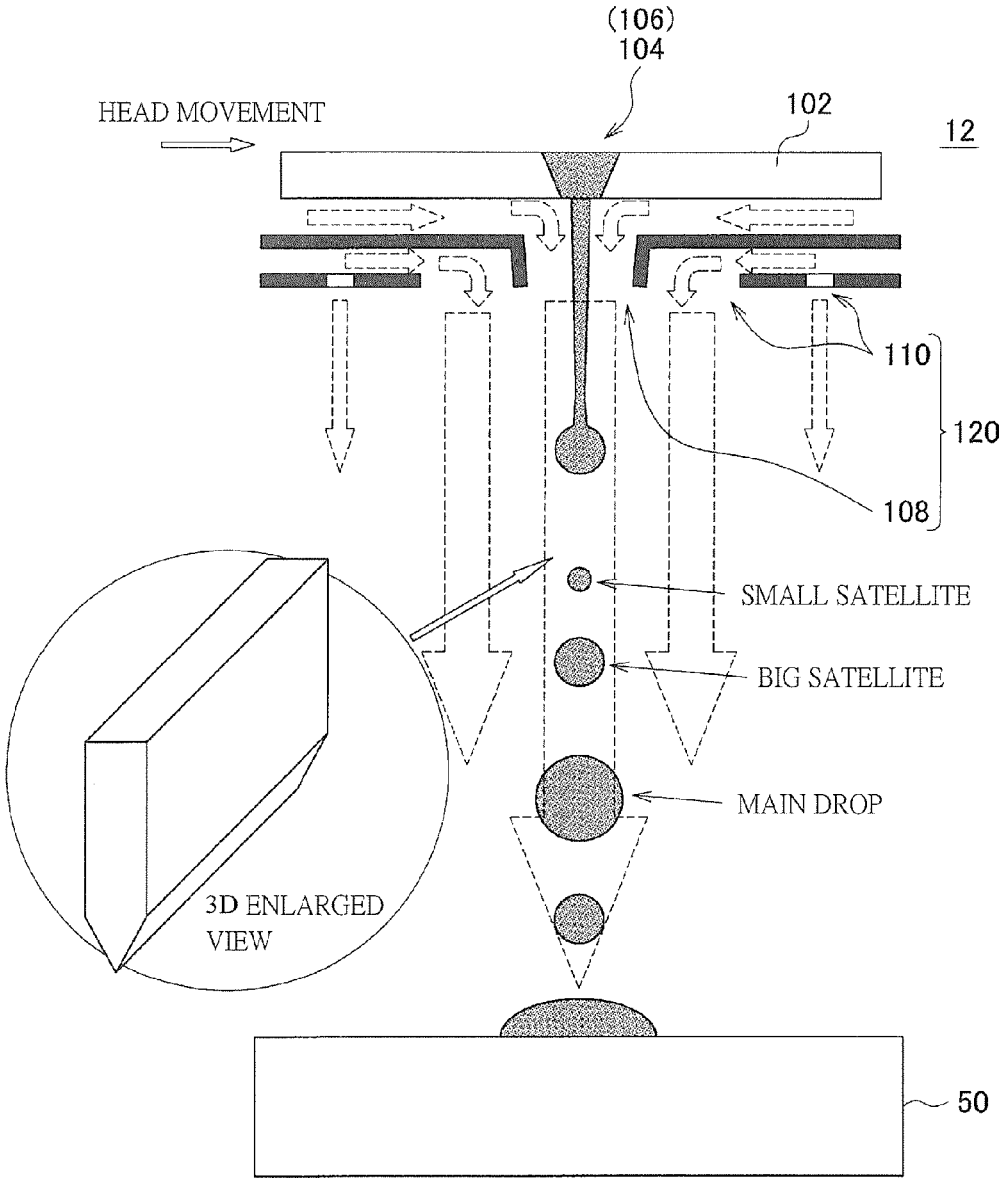
FIG. 3 is a more detailed drawing of an example of a structure of an inkjet head 12.
Figure 4:
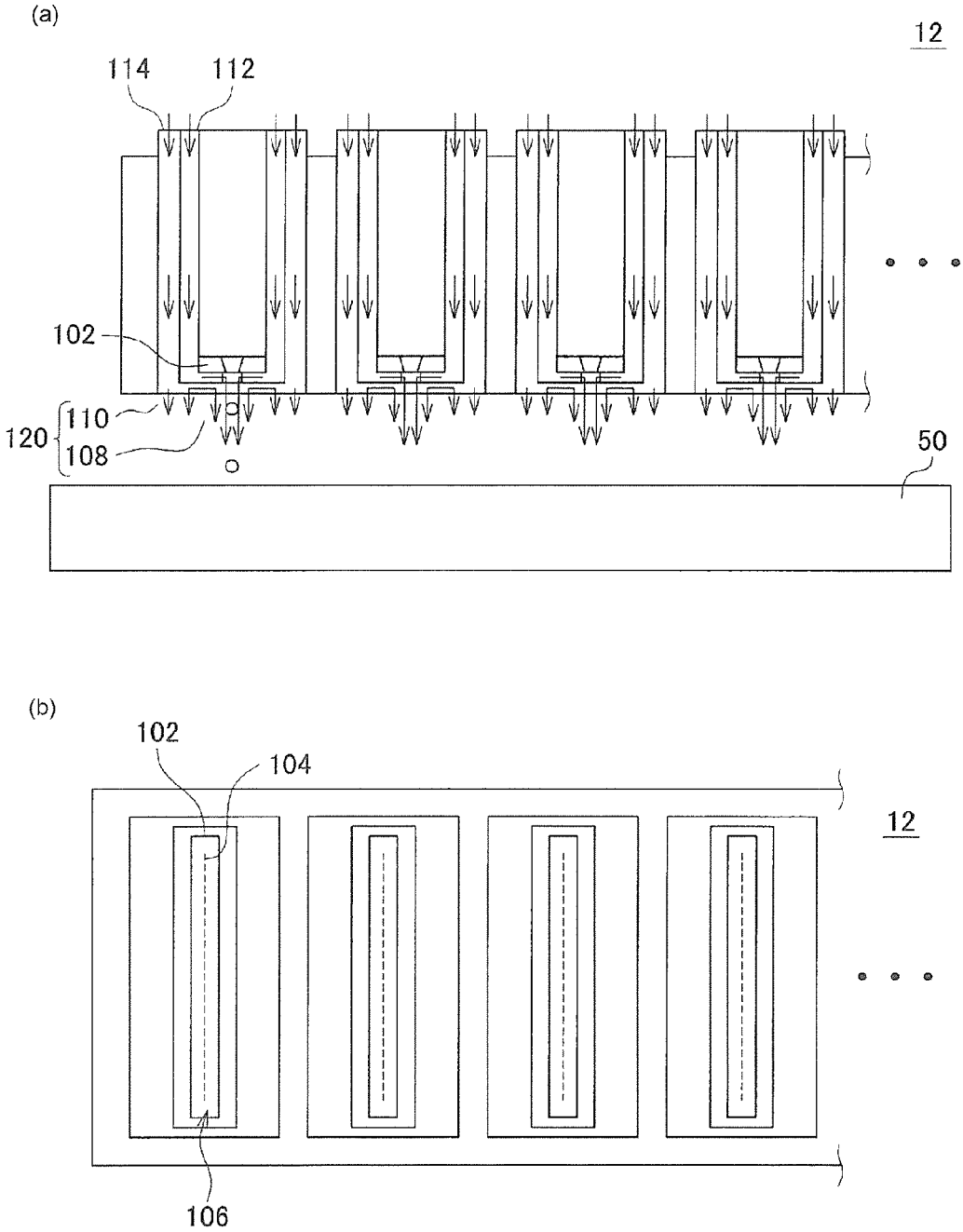
FIG. 4 is a more detailed drawing of a first example of a structure of the inkjet head 12 where (a) in FIG. 4 is a cross-sectional view of the inkjet head 12, and (b) in FIG. 4 is a drawing of the inkjet head 12 viewed from underside (nozzle surface).
Figure 5:
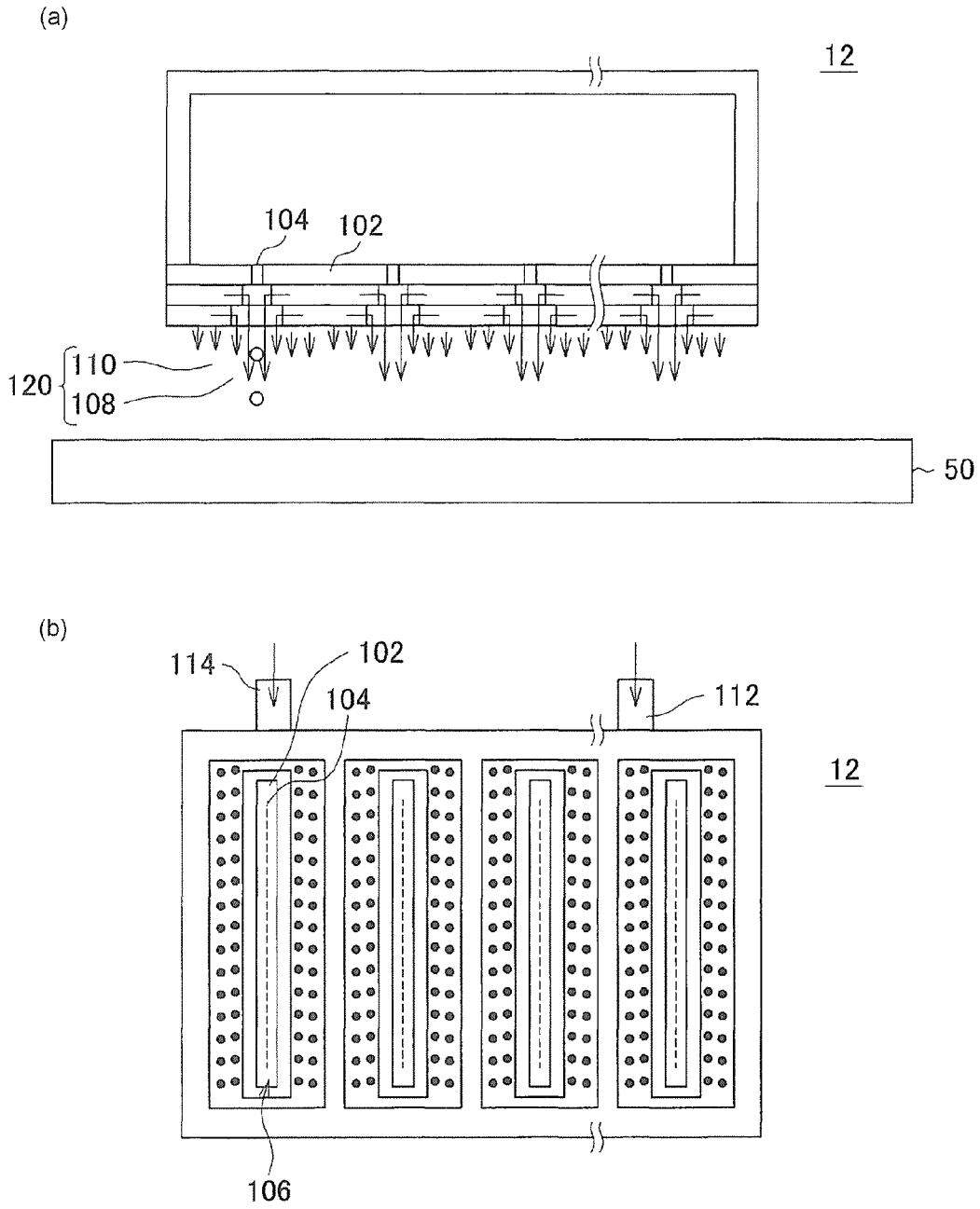
FIG. 5 is a more detailed drawing of a second example of a structure of the inkjet head 12 where (a) in FIG. 5 is a cross-sectional view of the inkjet head 12, and (b) in FIG. 5 is a drawing of the inkjet head 12 viewed from underside (nozzle surface).

The invention claimed is:

1. An inkjet printer that includes an inkjet head that discharges towards a printing medium an ink droplet of a metallic ink or a pearl-colored ink, wherein the inkjet head includes a nozzle that discharges the ink droplet towards the printing medium, wherein the nozzle is formed on the inkjet head on a nozzle surface thereof that faces the printing medium, and an air blowing unit that generates an airflow towards the printing medium along the ink droplet discharged from the nozzle, wherein the air blowing unit includes a primary-airflow blowing port that generates a primary airflow towards the printing medium along the ink droplet discharged from the nozzle, and that is formed adjacent to the nozzle on the nozzle surface, and a secondary-airflow blowing port that generates a secondary airflow towards the printing medium along the ink droplet at a position that is at a greater distance from the ink droplet than a distance from the ink droplet to the primary airflow, and that is formed adjacent to the nozzle on either side of the primary-airflow blowing port on the nozzle surface.

2. The inkjet printer according to claim 1, wherein the inkjet head includes a plurality of the nozzles arranged in a row as a nozzle row on a nozzle surface that faces the printing medium, and the air blowing unit generates a slit-shaped airflow on either side of the nozzle row from at least an area that is adjacent to two sides of the nozzle row on the nozzle surface and extends along a direction of the nozzle row.

3. The inkjet printer according to claim 1, wherein the inkjet head discharges the ink droplet from the nozzle at an initial speed that is such that a speed of the ink droplet at a time of deposition on the printing medium is higher than a speed of the airflow at a time the airflow reaches the printing medium.

4. The inkjet printer according to claim 1, further comprising:

an ink storage unit that stores therein the ink to be discharged from the nozzle; and a pressure adjusting unit that adjusts an ambient pressure of the ink storage unit, wherein the pressure adjusting unit adjusts the ambient pressure of the ink storage unit by relaying an airflow blowing pressure from the air blowing unit to the ink storage unit.

5. An inkjet printer comprising an inkjet head that discharges towards a printing medium an ink droplet of an ink that contains a pigment, wherein the inkjet head includes a nozzle that discharges the ink droplet towards the printing medium, wherein the nozzle is formed on the inkjet head on a nozzle surface thereof that faces the printing medium, and an air blowing unit that generates an airflow towards the printing medium along the ink droplet discharged from the nozzle, wherein the air blowing unit includes a primary-airflow blowing port that generates a primary airflow towards the printing medium along the ink droplet discharged from the nozzle, and that is formed adjacent to the nozzle on the nozzle surface, a secondary-airflow blowing port that generates a secondary airflow towards the printing medium along the ink droplet at a position that is at a greater distance from the ink droplet than a distance from the ink droplet to the primary airflow, and that is formed adjacent to the nozzle on either side of the primary-airflow blowing port on the nozzle surface, and wherein a length of the pigment in a longer direction is greater than or equal to ⅙th of a diameter of the ink droplet in a cross-section along a plane that is perpendicular to a direction from the nozzle to the printing medium.

6. The inkjet printer according to claim 5, wherein the inkjet head includes a plurality of the nozzles arranged in a row as a nozzle row on a nozzle surface that faces the printing medium, and the air blowing unit generates a slit-shaped airflow on either side of the nozzle row from at least an area that is adjacent to two sides of the nozzle row on the nozzle surface and extends along a direction of the nozzle row.

7. The inkjet printer according to claim 5, wherein the inkjet head discharges the ink droplet from the nozzle at an initial speed that is such that a speed of the ink droplet at a e of deposition on the printing medium is higher than a speed of the airflow at a time the airflow reaches the printing medium.

8. The inkjet printer according to claim 5, further comprising:

an ink storage unit that stores therein the ink to be discharged from the nozzle; and a pressure adjusting unit that adjusts an ambient pressure of the ink storage unit, wherein the pressure adjusting unit adjusts the ambient pressure of the ink storage unit by relaying an airflow blowing pressure from the air blowing unit to the ink storage unit.

9. An inkjet head that discharges an ink droplet of a metallic ink or a pearl-colored ink towards a printing medium, the inkjet head comprising:

a nozzle that discharges the ink droplet towards the printing medium, wherein the nozzle is formed on the inkjet head on a nozzle surface thereof that faces the printing medium; and an air blowing unit that generates an airflow towards the printing medium along the ink droplet discharged from the nozzle, wherein the air blowing unit includes a primary-airflow blowing port that generates a primary airflow towards the printing medium along the ink droplet discharged from the nozzle, and that is formed adjacent to the nozzle on the nozzle surface, and a secondary-airflow blowing port that generates a secondary airflow towards the printing medium along the ink droplet at a position that is at a greater distance from the ink droplet than a distance from the ink droplet to the primary airflow, and that is formed adjacent to the nozzle on either side of the primary-airflow blowing port on the nozzle surface.

10. An inkjet head that discharges towards a printing medium an ink droplet of an ink that contains a pigment, the inkjet head comprising:

a nozzle that discharges the ink droplet towards the printing medium, wherein the nozzle is formed on the inkjet head on a nozzle surface thereof that faces the printing medium; and an air blowing unit that generates an airflow towards the printing medium along the ink droplet discharged from the nozzle, wherein the air blowing unit includes a primary-airflow blowing port that generates a primary airflow towards the printing medium along the ink droplet discharged from the nozzle, and that is formed adjacent to the nozzle on the nozzle surface, and a secondary-airflow blowing port that generates a secondary airflow towards the printing medium along the ink droplet at a position that is at a greater distance from the ink droplet than a distance from the ink droplet to the primary airflow, and that is formed adjacent to the nozzle on either side of the primary-airflow blowing port on the nozzle surface, wherein a length of the pigment in a longer direction is greater than or equal to ⅙th of a diameter of the ink droplet in a cross-section along a plane that is perpendicular to a direction from the nozzle to the printing medium.

11. A printing method for printing by an inkjet method by discharging an ink droplet of a metallic ink or a pearl-colored ink towards a printing medium, the printing method comprising:

discharging the ink droplet from a nozzle towards the printing medium, wherein the nozzle is formed on the inkjet head on a nozzle surface thereof that faces the printing medium; and blowing from an air blowing unit an airflow towards the printing medium along the ink droplet discharged from the nozzle, wherein the air blowing unit includes a primary-airflow blowing port that generates a primary airflow towards the printing medium along the ink droplet discharged from the nozzle, and that is formed adjacent to the nozzle on the nozzle surface, and a secondary-airflow blowing port that generates a secondary airflow towards the printing medium along the ink droplet at a position that is at a greater distance from the ink droplet than a distance from the ink droplet to the primary airflow, and that is formed adjacent to the nozzle on either side of the primary-airflow blowing port on the nozzle surface.

12. A printing method for printing by an inkjet method by discharging an ink droplet of an ink containing pigments towards a printing medium, wherein a length of the pigment in a longer direction is greater than or equal to ⅙th of a diameter of the ink droplet in a cross-section along a plane that is perpendicular to a direction from a nozzle to the printing medium, wherein the nozzle is formed on the inkjet head on a nozzle surface thereof that faces the printing medium, the printing method comprising:

discharging the ink droplet from the nozzle towards the printing medium; and blowing from an air blowing unit an airflow towards the printing medium along the ink droplet discharged from the nozzle, wherein the air blowing unit includes a primary-airflow blowing port that generates a primary airflow towards the printing medium along the ink droplet discharged from the nozzle, and that is formed adjacent to the nozzle on the nozzle surface, and a secondary-airflow blowing port that generates a secondary airflow towards the printing medium along the ink droplet at a position that is at a greater distance from the ink droplet than a distance from the ink droplet to the primary airflow, and that is formed adjacent to the nozzle on either side of the primary-airflow blowing port on the nozzle surface.

* * * * *